US005782568A

United States Patent [19]

Röder et al.

[11] Patent Number: 5,782,568

[45] Date of Patent: Jul. 21, 1998

[54] APPLICATION SYSTEM

[75] Inventors: Georg Röder, Schwabach; Ulrich Griebel, Altdorf; Wolfgang Winkler, Lauf/Pegnitz, all of Germany

[73] Assignee: Schwan-STABILO Cosmetics GmbH & Co., Heroldsberg, Germany

[21] Appl. No.: 619,761

[22] PCT Filed: Jan. 24, 1995

[86] PCT No.: PCT/DE95/00103

§ 371 Date: Mar. 26, 1996

§ 102(e) Date: Mar. 26, 1996

[87] PCT Pub. No.: WO95/20891

PCT Pub. Date: Aug. 10, 1995

[30] Foreign Application Priority Data

Feb. 7, 1994 [DE] Germany ..... 44 03 689.2

[51] Int. Cl.[6] ..... A46B 11/04

[52] U.S. Cl. ..... 401/122; 401/129

[58] Field of Search ..... 401/122, 129, 401/130

[56] References Cited

U.S. PATENT DOCUMENTS 2,691,184 10/1954 Miller et al. .
3,115,270 12/1963 Melnikoff .
3,311,941 4/1967 Buchwalter et al. .
3,951,157 4/1976 Idec .
4,101,225 7/1978 Linz et al. .
4,189,245 2/1980 Bennett .
4,796,647 1/1989 Gueret .
4,841,996 6/1989 Gueret .
4,974,980 12/1990 Gueret .
5,242,232 9/1993 Kuhn ..... 401/130 X
5,324,128 6/1994 Gueret .

*Primary Examiner*—Steven A. Bratlie
*Attorney, Agent, or Firm*—Bachman & LaPointe, P.C.

[57] ABSTRACT

Described is an application system (10) having an applicator (16) and a container (12) in which a liquid application medium (14) is disposed. The applicator (16) has a handle (18) and an applicator member (20) which can be wetted with the liquid application medium, and it can be introduced into the container (12) through an opening (26), with the applicator member (20) leading. Starting from the opening (26), extending into the container (12) is a sleeve (32) which is sealingly fixed to the container (12) with its upper end portion (36) and which at a middle portion (42) is provided with at least one aperture (44) through which the inside of the sleeve (32) is communicated with the interior of the container (12), which surrounds the sleeve (32). The sleeve (32) is also provided with a shaping portion (48) which serves for re-shaping the applicator member (20).

10 Claims, 4 Drawing Sheets

APPLICATION SYSTEM

BACKGROUND OF THE INVENTION

The invention concerns an application system comprising an applicator and a container which is provided for a liquid application medium and into which the applicator having a handle and an applicator member which can be wetted with the liquid application medium can be introduced through the opening, with the applicator member leading, wherein the applicator seals off the container in the condition of being introduced into the container.

Application systems of that kind are known for example in the form of so-called dip liners which are used in the cosmetic area .

In the case of the known application systems of the above-indicated kind, after a prolonged period of use it is not out of the question that the applicator member becomes more or less useless because for example it may adopt a fanned-out configuration. It is also to be noted that, in the case of the known application systems of the kind set forth in the opening part of this specification, the application medium often cannot be completely removed from the container, that is to say, a residue of the application medium may be left behind in the container.

U.S. Pat. No. 4,880,326 discloses an application system having an applicator and a container for an application medium. In that system the container forms a closure cap for an applicator of a pencil-like configuration. The application medium is of a pasty consistency, more specifically that involving an applicator in the manner of a lip pencil. The applicator can be introduced into the cap-shaped container, with the applicator member leading, in which case the applicator seals off the container in the condition of being introduced into the container. In that known application system, provided in the interior of the cap-like container is a screwthreaded spindle which is secured to a fixing element. The screwthreaded spindle is screwed through a piston element which is secured against rotary movement in the cap-like container and which is axially movably guided therein. Rotary movement of the applicator which is fitted on to the cap-like container, about its longitudinal axis, provides for corresponding rotary movement of the fixing element and with same a rotary movement of the screwthreaded spindle. That rotary movement of the screwthreaded spindle is converted into an axial movement of the piston. By virtue of that axial movement of the piston, the pasty application medium is moved forwardly towards the applicator member in the cap-like container. An application system is also known from DE 37 30 838 Al.

The object of the present invention is to provide an application system of the kind stated in the opening part of this specification, which, while being of a simple design configuration, does not suffer from the above-mentioned disadvantages, that is to say in which the applicator member is subjected to a subsequent shaping effect almost at any time, and in which also the last residues of the application medium can be removed from the container.

SUMMARY OF THE INVENTION

In an application system of the kind set forth in the opening part of this specification, in accordance with the invention that object is attained in that starting from the opening a sleeve extends into the container, which sleeve is sealingly fixed with its end portion at its upper end to the container and which at a middle portion is formed with at least one aperture communicating the inside of the sleeve with the interior of the container surrounding the sleeve and which at its end portion at its lower end is formed with a conically tapered shaping portion for re-shaping the applicator member, wherein adjoining the shaping portion at the front or lower end is a sleeve end portion which touches the bottom of the container and which is provided with capillary slots.

For the purposes of sealingly fixing the sleeve in the opening in the container, the sleeve may be provided at its top end with a bead or ridge which extends therearound on the outside and, axially spaced from the bead or ridge, with support elements which also project outwardly, wherein the sleeve is axially immovably fixed in the opening of the container by said peripherally extending bead or ridge and the support elements.

By virtue of the fact that, if the shaping portion of the sleeve is of a conically tapered configuration and adjoining the shaping portion at the front or lower end thereof is a sleeve end portion which touches the bottom of the container and which is provided with capillary slots, reliable re-shaping of the applicator member of the applicator when fitted into the container and optimum wetting of the applicator member with application medium are advantageously achieved. The capillary slots in the front end portion of the sleeve make it possible for even the last residues of the application medium in the container to be conveyed through the capillary slots into the interior of the sleeve or into the adjoining conical shaping portion, and for the applicator member to be wetted with those last residues of the liquid application medium. As, in accordance with the invention, the front sleeve end portion which has the capillary slots touches the bottom of the container, complete emptying of the container is thus possible. Furthermore, that design configuration with the front end portion of the sleeve bearing against the bottom of the container provides for accurately defined positioning of the sleeve in the container, in which respect the fact that the sleeve end portion has capillary slots also makes it possible to compensate for certain dimensional tolerances in respect of the sleeve and the container.

It has been found desirable if provided at the periphery of the sleeve is a number of apertures which are in the form of axially extending longitudinal slots. Those longitudinal slots which are preferably equidistantly spaced around the periphery of the sleeve may be of internal dimensions such that they produce a capillary conveying action for the application medium from the container into the interior of the sleeve. That provides that the applicator disposed in the container, or the applicator member thereof, is reliably supplied with application medium.

It is advantageous if the container is provided with a neck portion which defines its opening and to which the sleeve is fixed. For the purposes of sealingly fixing the sleeve in the neck portion of the container, the internal cross-section of the neck portion is suitably matched to the external cross-section of the sleeve.

It is desirable if, in the application system according to the invention, at its upper end portion the sleeve has an inwardly facing bead or ridge which forms a scraper or stripper for the applicator as it moves out of the container. As the applicator is pulled out, the scraper scrapes surplus application medium off the applicator so that only a precisely defined amount of the application medium is provided on the applicator or the applicator member, in the condition in which it is removed from the container. The corresponding cosmetic use such as for example pencilling in an eyelid line is consequently possible with a very great degree of accuracy.

As the application system according to the invention usually employs a liquid application medium which contains color pigments in a suitable solvent, it is desirable if at least one mixing body is freely movably disposed in the container of the application system according to the invention. The at least one mixing body is for example a ball of metal, plastic material or the like. Uniform mixing of the application medium which has possibly sedimented out is effected by virtue of the free mobility of said at least one mixing body, by shaking the container which is closed with the applicator, and by virtue of the resulting movement of the at least one mixing body.

An application system which can be adapted to any customer requirements easily and without involving problems is afforded if, in accordance with the invention, the applicator member is fixed to an intermediate part which is secured to the handle of the applicator. In that respect it is desirable if the applicator member is formed with a fixing portion with which it is fixed to an end portion of the intermediate part, and if, at the second end portion remote from the first end portion, the intermediate part has a securing portion with which it is secured to the handle of the applicator. Such a three-part configuration of the applicator comprising handle, intermediate part and applicator member affords the possibility of combining different applicator members with different handles, as required. Thus the applicator member may be for example in the form of a small brush in which the brush bristles project from the fixing portion. Likewise it is possible for the applicator member to be formed from a porous sintered material, a fiber wick or the like, and for the fixing portion to be formed in one piece for example with the applicator member. The handle of the applicator may be in the form of a thin or comparatively thick handle stick or in the form of a body portion with a receiving space for a further applicator, that is to say in the manner of a protective cap for such a further applicator, or of any other desired configuration.

A particularly high level of writing or marking performance is achieved with the application system according to the invention if the intermediate part is formed with a blind hole in which the applicator member is fixed with its fixing portion, wherein the wall of the intermediate part, which surrounds the blind hole, has at least one capillary aperture. That at least one capillary aperture can be in the form of a longitudinal slot which extends in the axial direction from the edge of the intermediate part, which is adjacent to the applicator member. It is helpful for the same purpose, that is to say a high level of writing or marking performance, if the application system according to the invention provides that the wall of the blind hole of the intermediate part is formed alternately with ribs and capillary channels or grooves, in the peripheral direction. The capillary channels form an additional capillary storage volume which makes a corresponding contribution to the writing or marking performance of the application system. In that arrangement the ribs between adjacent capillary channels serve at the same time for reliably fixing the applicator member with its fixing portion in the blind hole of the intermediate part.

It is advantageous if, in the application system according to the invention, the neck portion of the container is provided with an external screwthread and the handle portion of the applicator is provided with a corresponding internal screwthread portion. That configuration not only permits reliable securing of the applicator to the container, but it also ensures reliable sealing of the specified parts of the system. In addition, such a screw connection between the applicator and the container advantageously makes it possible to provide for accurately defined and reliable re-shaping of the applicator member while the applicator is being screwed into the container.

BRIEF DESCRIPTION OF THE DRAWINGS

Further details, features and advantages are apparent from the following description of an embodiment illustrated in the drawing of the application system according to the invention. In the drawing.

DETAILED DESCRIPTION

Figure 1:
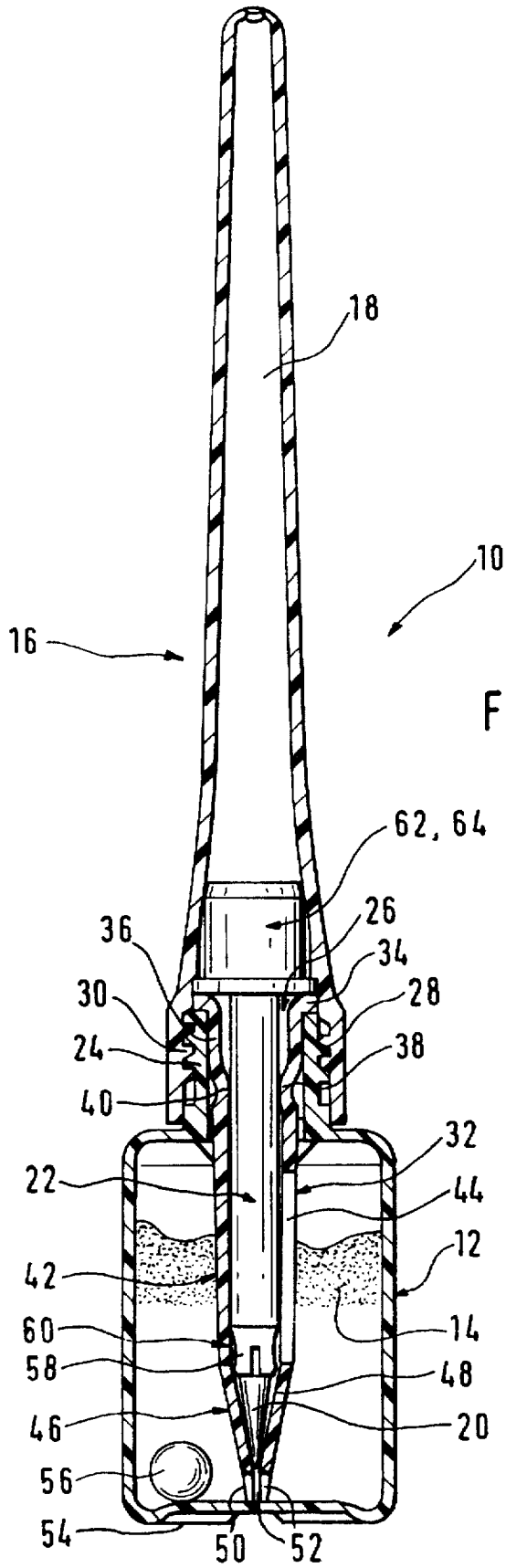
FIG. 1 is a view in longitudinal section on an enlarged scale of a configuration of the application system.

FIG. 1 shows an embodiment of the application system 10 with a container 12 for an application medium 14 and with an applicator 16 having a handle 18 and an applicator member 20, wherein the applicator member 20 is connected to the handle by means of an intermediate part 22.

The container 12 is provided with a neck portion 24 which defines an opening 26 of the container 12. The neck portion 24 is provided with an external screwthread 28. The handle 18 of the applicator 16 has an internal screwthread 30, corresponding to the external screwthread 28, so that it is possible for the applicator 16 to be screwed with its handle 18 on to the container 12 or the neck portion 24 thereof.

Arranged in the opening 26 of the container 12 is a sleeve 32 which at the upper end has an outwardly facing peripherally extending bead or ridge 34 and contact hooks, at a spacing from the bead 34. The bead 34 definedly limits the insertion movement of the sleeve 32 into the container 12. The sleeve 32 is sealingly fixed in the neck portion 24 of the container 12 by means of a portion 36 adjoining the bead 34, in the neck portion 24 of the container 12. Adjoining the last-mentioned portion 36 of the sleeve 32 is an inwardly facing bead or ridge 38 which extends around the sleeve 32 at the inside thereof and which forms a scraper or stripper 40 which bears closely against the intermediate part 22 of the applicator 16. In a middle portion 42 the sleeve 32 is provided with openings which are in the form of axially extending longitudinal slots 44. One of the longitudinal slots 44 can be seen on the right-hand side of the sleeve 32 in FIG. 1.

The lower end portion 46 of the sleeve 32 is of a conically tapered configuration and serves as a shaping portion 48 for reshaping of the applicator member 20 of the applicator 16 when it is fitted into the container 12. Adjoining the conically tapered shaping portion 48 of the sleeve 32 at the lower end thereof is a sleeve end portion 50 which is formed with capillary slots 52. The last-mentioned lower end portion 50 of the sleeve bears against the bottom 54 of the container 12 so that by means of the capillary slots 52 in the sleeve end portion 50, even the last residues of the application medium 14 in the container 12 are transported through the capillary slots 52 into the shaping portion 48 of the sleeve 32 in order there suitably to wet the applicator member 20.

Freely movably disposed in the container 12 is at least one mixing body 56 which serves to properly thoroughly mix again the application medium 14 which has possibly sedimented out, by virtue of the application medium 14 being shaken. The at least one mixing body 56 is for example a ball.

The applicator member 20 is formed with a fixing portion 58 with which it is fixed to the associated end portion 60 of the intermediate part 22. At its second end portion 62 which is remote from the end portion 60 the intermediate part 22 has a securing portion 64 with which the intermediate part 22 is secured to the handle 18 of the applicator 16. That securing action is effected for example by pressing. The applicator member 20 can be mechanically fixedly connected in a corresponding manner by pressing to the first end portion 60 of the intermediate part 22.

Figure 2:
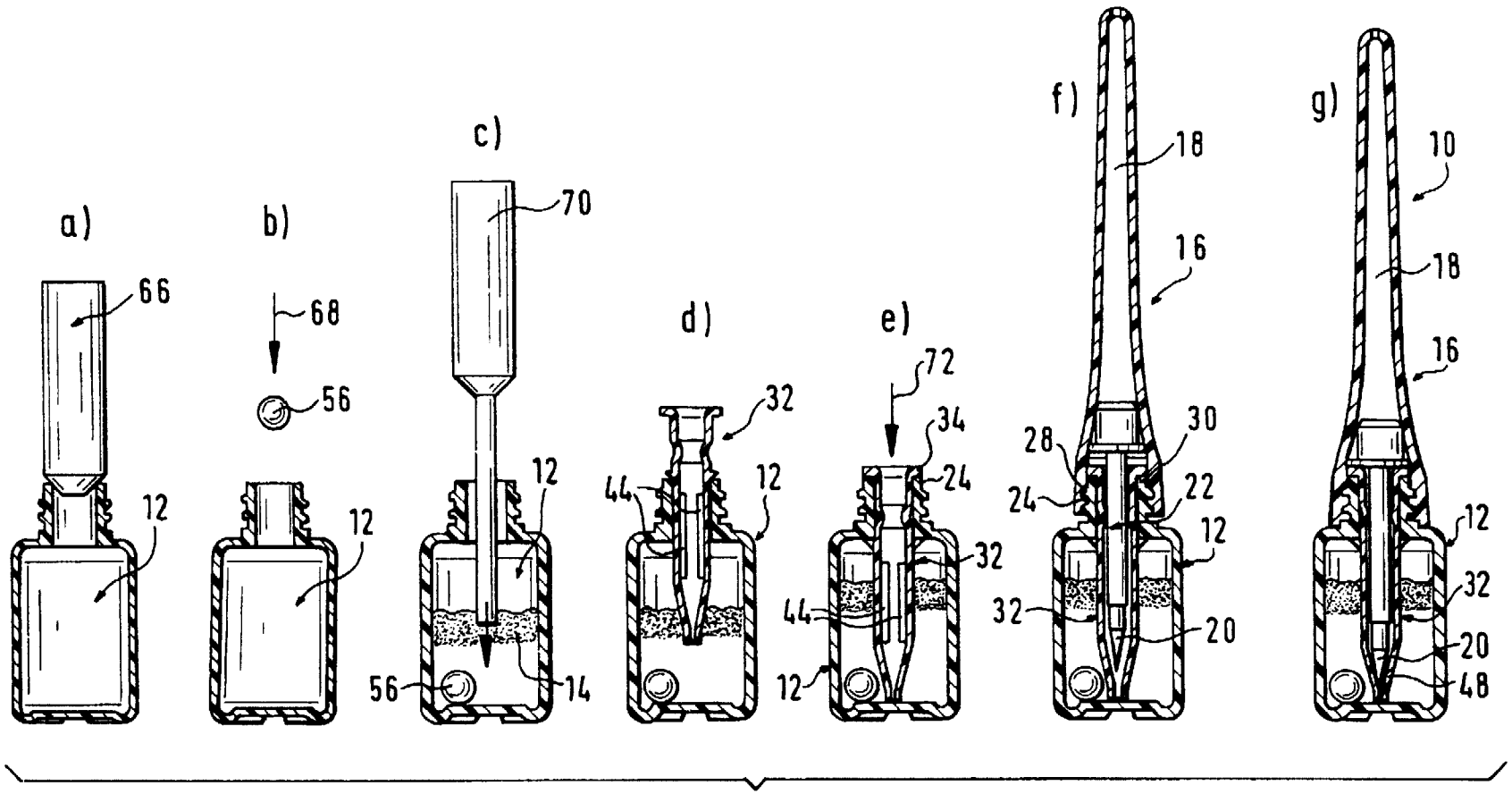
FIG. 2 shows successive working steps for production of the application system shown in FIG. 1.

FIG. 2 shows in successive working steps the production of an application system 10 as illustrated in FIG. 1, wherein working step a) in FIG. 2 indicates testing of the container 12 in respect of sealing integrity by means of a testing head 66. As soon as it has been established that the container 12 enjoys suitable sealing integrity, introduced into the container 12 is at least one mixing body 56, as is indicated by the arrow 68 in working step b) in FIG. 2. Then, in working step c) in FIG. 2, a suitable application medium 14 is introduced into the container 12 which is fitted with the at least one mixing body 56, by means of a filling device 70. That application medium 14 is for example a suitable ink, with for example between about 2 to 5 ml of the ink being introduced into the container 12. Then in process step d) in FIG. 2, inserted into the container 12 when prepared in that way is a sleeve 32 which is subsequently moved into the container 12 in process step e) in FIG. 2 until the bead 34 at the upper end of the sleeve 32 bears snugly against the neck portion 24 of the container 12. That insertion movement is indicated by the arrow 72 in process step e). The sleeve 32 is then immovably fixed by the bead 34 and contact hooks which are spaced therefrom.

Working step f) which follows working step e) in FIG. 2 illustrates the operation of fitting an applicator 16 on to the container 12, that is to say inserting the intermediate part 22 with the applicator member 20 into the sleeve 32 of the container 12 until the applicator 16 or its handle 18 bears with the internal screwthread 30 against the external screwthread 28 on the neck portion 24 of the container 12. Subsequently the applicator 16 is then screwed sealingly on to the container 12 by rotation of its handle 18, as illustrated by working step g) in FIG. 2. In that definitive condition of use the applicator member 20 bears snugly against the shaping portion 48 of the sleeve 32 so as to provide for re-shaping of the applicator member 20.

Figure 3:
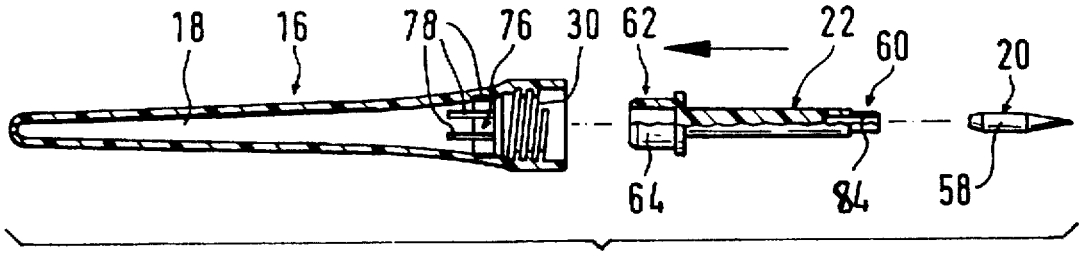
FIG. 3 is an exploded view of a handle, an intermediate part and an applicator member of the applicator of the application system shown in FIG. 1.

FIG. 3 is an exploded view of an applicator 16 with a handle 18, an intermediate part 22 and an applicator member 20 which is formed in one piece with a fixing portion 58. The intermediate part 22 is formed at the associated first end portion 60 with a blind hole 84 into which the applicator member 20 is moved with its fixing portion 58, and fixed therein. The second end portion 62 of the intermediate part 22, which is remote from the first end portion 60, has a securing portion 64 which is pressed into an associated portion 76 of the handle 18. For that purpose the portion 76 is formed for example with longitudinal ribs 78.The internal screwthread 30 with which the handle 18 is provided is also clearly apparent from FIG. 3.

Figure 4:
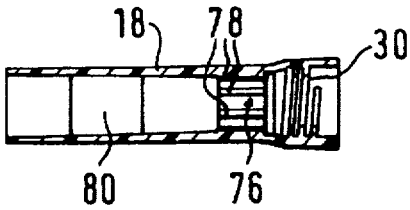
FIG. 4 is a view in longitudinal section through a second embodiment of the handle of a corresponding applicator.

FIG. 4 shows a handle 18 with a portion 76 which is formed with longitudinal ribs 78 and an internal screwthread 30 for screwing the handle 18 on to a corresponding container 12 (see for example FIG. 1). The handle 18 which is shown in longitudinal section in FIG. 4 is formed with a receiving space 80 which is provided for receiving and sealingly holding a further applicator such as for example a so-called cosmetic pencil.

Figure 5:
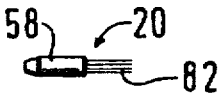
FIG. 5 shows a second configuration of the applicator member for an applicator as shown in FIG. 3.

FIG. 5 shows an applicator member 20 which is provided in the form of a brush with brush bristles 82 which project from a fixing portion 58. An applicator member 20 of that kind may also be combined with an intermediate part 22 as shown in FIG. 3.

Figure 6:
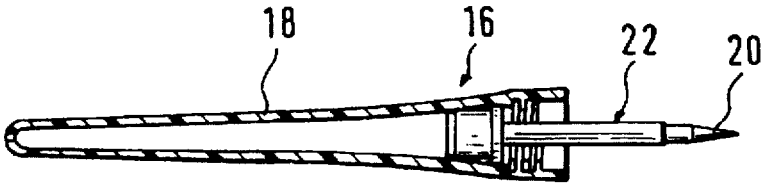
FIG. 6 shows the applicator of FIG. 3 in the assembled condition, with the handle being shown in longitudinal section.

FIG. 6 shows an applicator 16 whose handle 18 is shown in longitudinal section while the intermediate part 22 which is fixedly connected to the handle 18, with the applicator member 20 projecting away from the intermediate part 22 at the front end, is shown in a side view.

Figure 7:
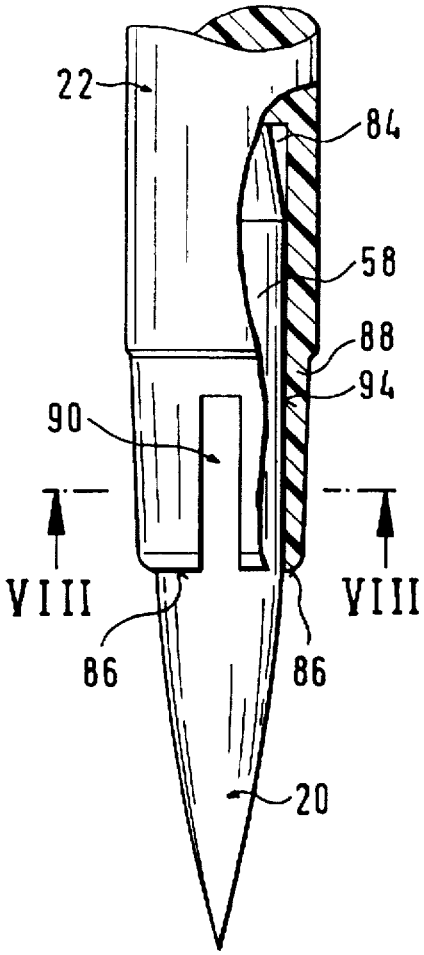
FIG. 7 is a side view on a greatly enlarged scale of a portion of the intermediate part, partly cut-away, in combination with the applicator member.
Figure 8:
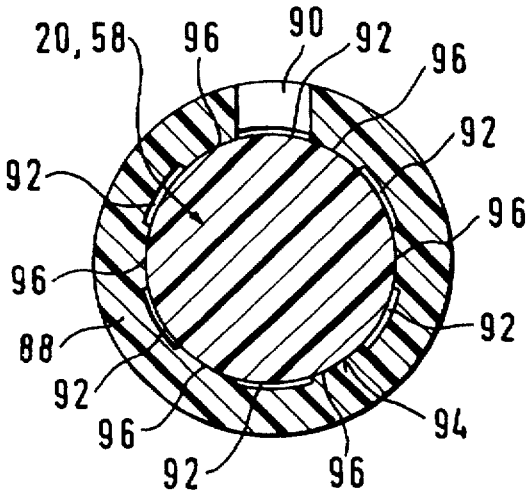
FIG. 8 is a view in section taken along section line VIII—VIII in FIG. 7 through the intermediate part and the fixing portion of the applicator member.

FIG. 7 is a side view on a greatly enlarged scale of a portion of the intermediate part 22 which is shown in partly cut-away form, in order to illustrate the fixing of the applicator member 20 in the intermediate part 22. For that purpose, at its end portion towards the applicator member 20, the intermediate part has a blind hole 84 which extends from the edge 86 towards the applicator member 20, into the interior of the intermediate part 22. Starting from the edge 86 the all 88 of the intermediate part 22, which embraces the blind hole 84, has at least one capillary aperture 90. The capillary aperture 90 forms a capillary storage means for the application medium 14 in the container 12 (see FIG. 1). A further additional capillary storage means for application medium is afforded by the capillary grooves or channels 92 which, as is clearly apparent from FIG. 8, are provided in the wall 94 of the blind hole 84 of the intermediate part 22. The capillary channels 92 are spaced from each other by ribs 96 in the peripheral direction of the wall 94 of the blind hole 84. The ribs 96 serve for fixing the applicator member 20 in the blind hole 84 of the intermediate part 22.

We claim:

1. An applicator system comprising an applicator having a handle and an applicator member, a container having a liquid medium into which the applicator is inserted through an opening for wetting the applicator member with the liquid medium, wherein the applicator seals off the container when in a closed position, the improvement which comprises a hollow sleeve member extending into the container from the opening wherein the hollow sleeve member receives the applicator when in the closed position, said hollow sleeve member comprising an upper end, a middle portion and a lower end portion; said upper end of said hollow sleeve is sealingly fixed to the container at the opening; said middle portion is provided with at least one aperture communicating the hollow sleeve with the medium in the interior of the container surrounding the sleeve; and said lower end portion is formed of a conically tapered shaping portion for re-shaping the applicator member, wherein adjoining the shaping portion at the lower end portion of the hollow sleeve is a sleeve end portion which touches the bottom of the container, said sleeve end portion being provided with a plurality of capillary slots for communicating the medium in the interior of the container with the hollow sleeve portion.

2. An applicator system according to claim 1 wherein the middle portion of the hollow sleeve member is provided with a plurality of apertures, each of said apertures being in the form of an axially extending longitudinal slot.

3. An applicator system according to claim 1 wherein the container includes a neck portion which defines an opening and the hollow sleeve member is fixed to the neck portion.

4. An applicator system according to claim 3 wherein the neck portion of the container is provided with an external screwthread and the handle of the applicator is provided with a corresponding internal screwthread.

5. An applicator system according to claim 1 wherein the upper end of the hollow sleeve is provided with an inwardly facing bead which forms a wiper for the applicator as the applicator is drawn out of the container.

6. An applicator system according to claim 1 wherein at least one mixing means is provided in the liquid medium in the container.

7. An applicator system according to claim 1 wherein the applicator is provided with an intermediate part and the applicator member is fixed to one end of the intermediate part while the handle is secured to the other end of the intermediate part.

8. An applicator system according to claim 7 wherein the applicator member is formed with a fixing portion which is fixed to an end portion of the intermediate part.

9. An applicator system according to claim 8 wherein the intermediate part has a wall member defining a blind hole into which the applicator member is fixed, said wall being formed with at least one capillary aperture.

10. An applicator system according to claim 9 wherein the wall defining the blind hole is formed with a plurality of capillary channels and where ribs are provided between adjacent capillary channels.

* * * * *